US005919309A

United States Patent [19]

Kim et al.

[11] Patent Number: 5,919,309

[45] Date of Patent: Jul. 6, 1999

[54] DEVELOPING APPARATUS FOR A CATHODE-RAY TUBE PANEL

[75] Inventors: Young-kag Kim, Seoul; Won-hee Lee, Kyungki-do; Bong-mo Jeong, Seoul, all of Rep. of Korea

[73] Assignee: Samsung Display Devices Co., Ltd., Kyungki-do, Rep. of Korea

[21] Appl. No.: 08/790,567

[22] Filed: Jan. 29, 1997

[30] Foreign Application Priority Data

Apr. 3, 1996 [KR] Rep. of Korea ..... 96-10013

[51] Int. Cl.[6] ..... B05C 5/02; B05C 11/00

[52] U.S. Cl. ..... 118/629; 118/308; 118/600

[58] Field of Search ..... 118/308, 600, 118/621, 629; 430/23; 239/690, 704, 398, 303, 304, 306; 427/458, 475, 561

[56] References Cited

FOREIGN PATENT DOCUMENTS 647959 4/1995 European Pat. Off. .

*Primary Examiner*—David A. Simmons
*Assistant Examiner*—Calvin Padgett
*Attorney, Agent, or Firm*—Christie, Parker & Hale, LLP

[57] ABSTRACT

A CRT panel developing apparatus includes a body; a panel fixing portion, which is placed in the upper portion of the body and is structured so as to ground the conduction layer of the panel; a developing gun, which sprays powder that has been coated with organic matter on to the panel fixed to the panel fixing portion; a supply line, which is a passageway for the powder and air to be supplied to the developing gun; an air supply apparatus and a powder supply apparatus which are connected to the supply line; a powder charging portion, which is formed on the supply line that charges the powder that passes through the supply line; a turbulent air line which supplies air to the powder charging portion; a power supply apparatus that supplies electrical power to the powder charging portion; an evaporation portion, where the organic matter evaporates; an evaporation air line which supplies air to the evaporation portion; an evaporated organic matter line, which connects the evaporation portion and the supply line; an organic matter supply apparatus, which supplies organic matter to the evaporation portion; and an organic matter line that connects the evaporation portion and the organic matter supply apparatus.

13 Claims, 2 Drawing Sheets

DEVELOPING APPARATUS FOR A CATHODE-RAY TUBE PANEL

BACKGROUND

The present invention relates to a developing apparatus for CRT panels, and more particularly, to a developing apparatus for CRT panels that has a process in which evaporated organic matter, inside a developing gun, so as to be condensed, coats powder and it is sprayed out of the developing gun.

In the prior art, the process for forming a phosphor face on CRT panels includes the applying of a black matrix which entails the steps of washing panel, application polymeric conductor and photoconductor layer, charging, exposure, black matrix developer, and fuser. Next, the process for forming a phosphor face includes the following steps for applying a phosphor material: P.C. charging, G exposure, G developer, fuser, P.C. charger , B exposure, B developer, fuser, R exposure, R developer, fuser. In this way, phosphor material comes to be applied through a method of electrophotographically manufacturing a screen assembly.

In the above process of forming a black matrix and each of the R, G, B phosphor materials through a method of electrophotographically manufacturing a screen assembly, the developing apparatus of the prior art includes: a body; a panel fixing portion placed on the upper part of the body; a developing gun in which a charger electrode is placed; a powder supply line which supplies black matrix and powder of each R, G, B phosphor material (hereinafter referred to as just powder); a powder supply apparatus, connected to the powder supply line; an air supply line that supplies air to the developing gun and is installed separately from the powder supply line; an air supply apparatus connected to the air supply line; and an electric supply apparatus which supplies electricity to the charger electrode inside the developing gun. The structure of the above panel fixing portion is formed so that it grounds the panel it secures.

In the above formation of the prior art developing apparatus, when the CRT panel, which is positively charged and is exposed, is fixed to the panel fixing portion, the powder supply apparatus and the air supply apparatus start operating, and through the powder supply line and the air supply line, powder and air is supplied to the developing gun and the electricity supply apparatus provides electricity to the electrodes of the developing gun.

The powder, which by following the flow of the air that is supplied to the developing gun gets sprayed out from the developing gun. While being forced out, the powder is electrically charged (to the same positive pole as the panel) by the corona discharge of the electrode fixed to the exit of the developing gun.

The panel fixed to the panel fixing portion has formed, an electrical line through the charged and un-charged portion. This is realized because the charged portion and the un-charged portion are formed in a determined pattern by the operations of charging and exposure, and because the conduction layer is grounded by the panel fixing portion. As a result, the powder, which is charged to the same pole as the panel and shot out of the developing gun, follows the electrical line and adheres to the un-charged portion and is developed in a determined pattern.

When using the prior art developing apparatus composed as in the above, because the process of coating the powder, supplied to the developing apparatus, with a material used to control electrical charge and a material used for securing, needs to have the supplementary process of using heat or acetone to fix the developed powder to the panel, the developing process becomes complex.

Also, in the process of using heat or acetone to fix the developed powder to the panel, if the conduction layer or the photocunductive layer is thin, they become damaged by the heat or acetone. If this happens, when developing the three R, G, B colors, developing is barely achieved.

SUMMARY

The present invention has been made in an effort to solve the above problems.

It is an object of the present invention to provide a developing apparatus for a CRT panel that condenses and coats powder inside a developing fun, sprays the coated powder on a panel, and performs a developing operation.

To achieve the above object, a developing apparatus for a cathode-ray-tube panel which includes a body; a panel fixing portion, which is placed in the upper portion of the body and is structured so as to ground the conduction layer of the panel; a developing gun, which sprays powder that has been coated with an organic material on a panel fixed to the panel fixing portion; a supply line in which the powder and air passes through to be supplied to the developing gun; an air supply apparatus and a powder supply apparatus, connected to the supply line; a powder charging portion, which is formed on the supply line and electrically charges the powder that passes through the supply line; a turbulent air line that supplies air to the powder charging portion; a power supply apparatus that supplies electricity to the powder charging portion; an evaporation portion in which the organic matter evaporates; an evaporation air line which supplies air to the evaporation portion; an evaporated organic matter line that connects the evaporation portion with the supply line; an organic matter supply apparatus that supplies the organic matter to the evaporation portion; and an organic matter line that connects the evaporation portion with the organic matter supply apparatus.

According to a feature of the present invention, the developing gun comprises a trunk; a condenser that is placed outside the trunk; an entrance, which is formed on one side of the trunk and in which the powder and evaporated organic matter flows; a flow path, that is formed inside the trunk; an exit, formed on the other side of the trunk and from which the powder that has been coated with the condensed organic matter is sprayed; a drain hole for the recovering of the organic material that condenses on the inner wall of the trunk; and an air hole that blows air so that the powder that flows into the trunk does not stay stuck to the wall and is directed toward the exit.

According to another feature of the present invention, the powder charging portion comprises a ground electrode, fixed to a line wall of the supply line; a fan-shaped electrode fixed to the central part of the supply line and connected to the power supply apparatus; an air flow mouth that is spiral-shaped and is formed adjacent to the line wall of the supply line; and a turbulent air line that connects the air flow mouth and the air supply apparatus.

According to still another feature of the present invention, the evaporation portion comprises an evaporation vessel; glass beads, which fill the inside of the evaporation vessel; an air entrance, which is connected to the evaporation air line; an organic matter entrance, connected to the organic matter supply line; an evaporator, fixed to the outside of the evaporation vessel; and a evaporation exit, which is connected to the evaporated organic matter line.

In the developing apparatus for a cathode-ray-tube panel of the present invention with the above composition, when the panel fixing portion is fixed to the panel, the air supply apparatus operates, air is supplied through the supply line, and the powder, that is supplied from the powder supply apparatus, by following the flow of the air, moves to the developing gun. At this time, a corona discharge is generated in the fan-shaped electrode according to the electricity that is supplied from the power supply apparatus to the fan-shaped electrode of the powder charging portion, and the powder that flows from the powder charging portion, comes to be charged. In addition, an ion layer is formed inside the supply line by the grounding electrode that is fixed to the powder charging portion, and when air is blown from the air supply apparatus to the spiral-shaped air inflow mouth through the turbulent air line, turbulence is formed inside the powder charging portion, and because the powder that moves from following this turbulence is charged by contacting the ion layer formed inside the supply line, the charging of the powder is better achieved.

In the evaporation portion, the evaporation vessel and the glass beads that fill the evaporation vessel are heated by the evaporated steam, and kept at a temperature higher than the organic matter evaporation temperature, and the organic matter that is flowed into the mouth of the organic matter entrance is evaporated by contact with the inside of the evaporation vessel and the glass beads. The evaporated organic matter, by the current of air that is flowed into the air entrance, is directed toward the evaporation exit.

When the powder, which is charged in the powder charging portion, and the steam of the organic matter, which is evaporated in the evaporation portion, in this mixed state, flows into the entrance of the developing gun, and as the temperature of the flow path formed in the trunk of the developing gun is kept below the condensation temperature of the organic matter, the steam of the organic matter is condensed by the condenser and covers the outside of the powder.

The powder, which is covered by the condensed organic matter, does not stick to the inside surface of the developing gun because of the air that flows in from the air hole of the developing gun, but is sprayed out the exit by the flowing air and adheres to the panel that is fixed to the panel fixing portion. At this time, by the grounding of the panel conduction layer through the panel fixing portion, an electrical line is formed according to the charged pattern of the panel in the charging process. Also, the powder, which is sprayed out through the exit of the developing gun, as it becomes charged in the powder charging portion, the sprayed powder adheres to the panel in a determined pattern. In addition, because of the exceptional absorption power of the organic matter, the powder is adhered fast to the panel, and because of the surface tension of the liquid organic material, the space surrounding the powder is uniformly adhered without missed portions.

The organic matter, which is condensed inside the developing gun, flows through the inside of the developing gun and is retrieved in the drain hole. The retrieved organic matter is re-processed and supplied to the organic matter supply apparatus.

BRIEF DESCRIPTION OF THE DRAWINGS

Further objects and other advantages of the present invention will become apparent from the following description in conjunction with the attached drawing, in which.

DESCRIPTION

Embodiments will be described below in conjunction with the accompanying drawings.

Figure 1:
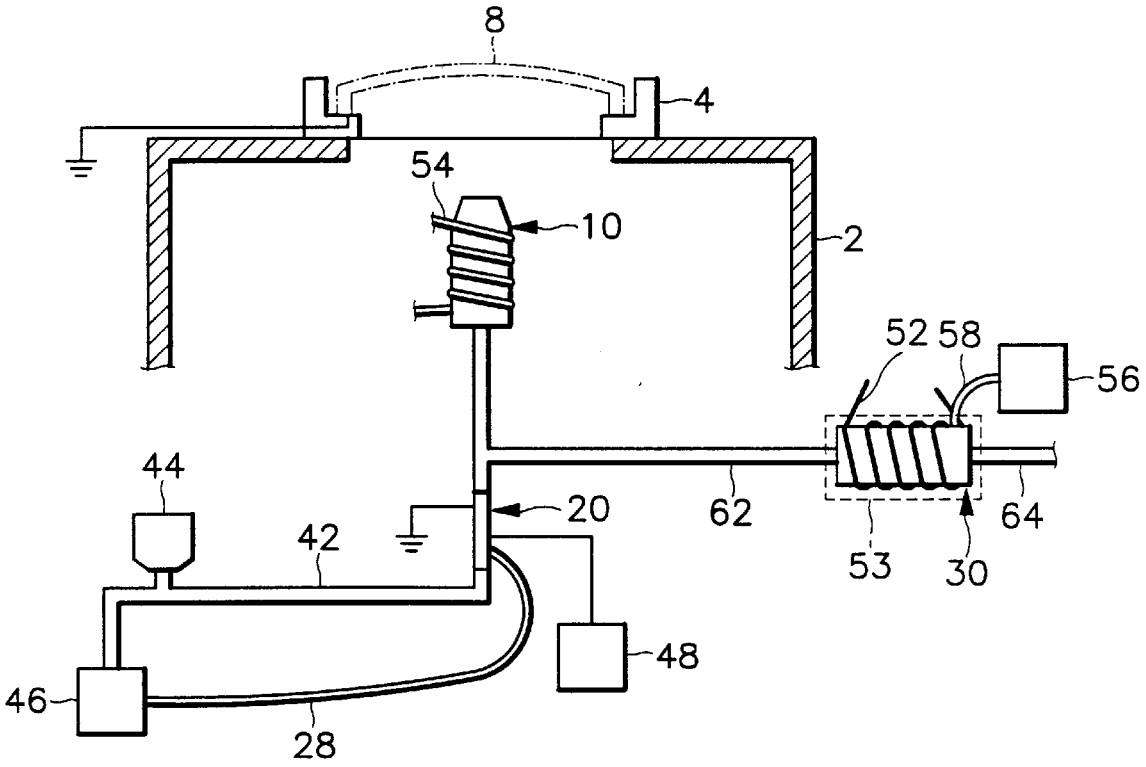
FIG. 1 is a partially sectional view of a developing apparatus for a cathode-ray-tube panel according to one embodiment of the present invention.

As is shown in FIG. 1, a CRT panel developing apparatus according to a preferred embodiment of the present invention includes a body 2; a panel fixing portion 4, which is fixed to the upper portion of the body 2 and is structured so as to ground a conduction layer of a panel 4; a developing gun 10, which sprays powder that has been coated with organic matter on to the panel 8 fixed to the panel fixing portion 4; a supply line 42, which is a passageway for the powder and air to be supplied to the developing gun 10; an air supply apparatus 46 and a powder supply apparatus 44 which are connected to the supply line 42; a powder charging portion 20, which is formed on the supply line 42 that charges the powder that passes through the supply line 42; a turbulent air line 28 which supplies air to the powder charging portion 20; a power supply apparatus 48 that supplies electrical power to the powder charging portion 20; an evaporation portion 30, where the organic matter evaporates; an evaporation air line 64 which supplies air to the evaporation portion 30; an evaporated organic matter line 62, which connects the evaporation portion 30 and the supply line 42; an organic matter supply apparatus 56, which supplies organic matter to the evaporation portion 30; and an organic matter line 58 that connects the evaporation portion 30 and the organic matter supply apparatus 56.

For the organic matter, DOP (dioctyl phthalate), DBP (dibutyl phthalate), DOS (dioctyl sebacate), LA (linolenic acid), OA (oleic acid), SA (stearic acid), G (glycerol), etc. is used.

Figure 2:
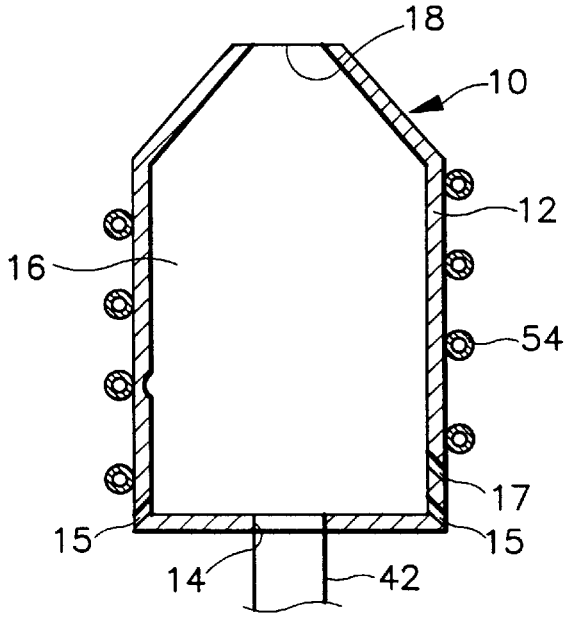
FIG. 2 is a sectional view of a developing gun according to one embodiment of the present invention.

The above developing gun 10, as is shown in FIG. 2, comprises a trunk 12; a condenser 54 that is fixed outside the trunk 12; an entrance 14, which is formed on one side of the trunk and in which the powder and evaporated organic matter flows; a flow path 16 that is formed inside the trunk 12; an exit 18, formed on the other side of the trunk 12 and from which the powder that has been coated with the condensed organic matter is sprayed; a drain hole 17 for the recovering of the organic material that condenses on the inner wall of the trunk 12; and an air hole 15 that blows air so that the powder that flows into the trunk does not stay stuck to the wall and is directed toward the exit 18.

The above condenser 54 is pipe-shaped so as to be able to use cold water, etc., and it is wrapped around the trunk 12 of the developing gun 10. Also, the drain hole 17, through the drain line (not shown), is connected to the organic matter treatment apparatus (not shown) and the organic matter supply apparatus 56, and the air hole 15, through the air supply line (not shown), is connected to the air supply apparatus 46.

Figure 3:
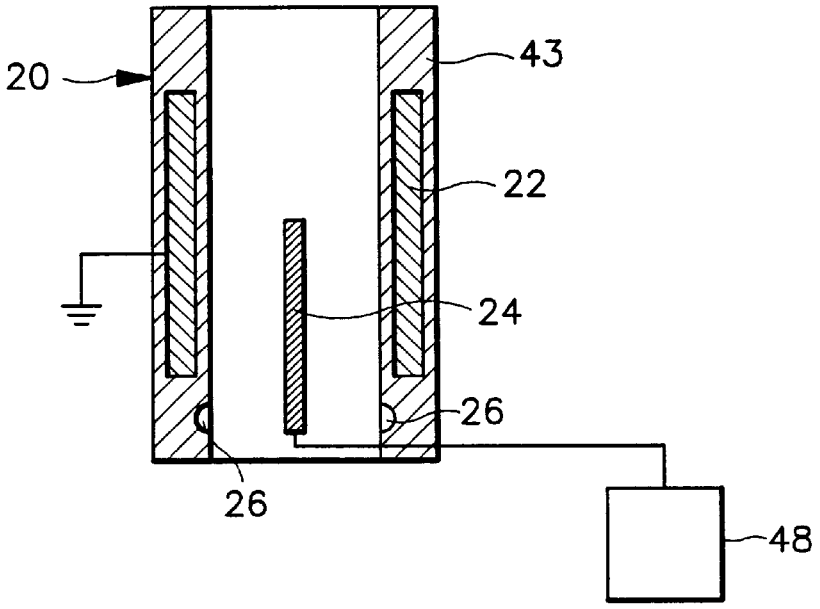
FIG. 3 is a sectional view of a powder charging portion according to one embodiment of the present invention.

The above powder charging portion 20, as is shown in FIG. 3, comprises a ground electrode 22, fixed to a line wall 43 of the supply line 42; a fan-shaped electrode 24 fixed to the central part of the supply line 42 and connected to the power supply apparatus 48; an air flow mouth 26 that is spiral-shaped and is formed adjacent to the line wall 43 of the supply line 42; and a turbulent air line 28 that connects the air flow mouth 26 and the air supply apparatus 48.

Figure 4:
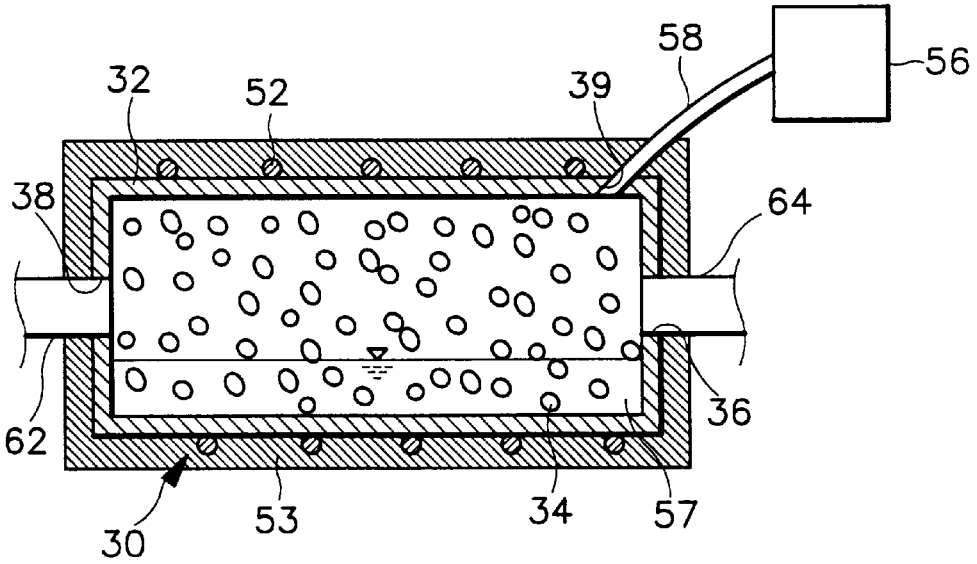
FIG. 4 is a sectional view of an evaporation portion according to one embodiment of the present invention.

The above evaporation portion 30, as is shown in FIG. 4, comprises an evaporation vessel 32; glass beads 34, which fill the inside of the evaporation vessel 32; an air entrance 36, which is connected to the evaporation air line 64; an organic matter entrance 39, connected to the organic matter supply line 58; a evaporator 52, fixed to the outside of the evaporation vessel 32; and an evaporated exit 38, which is connected to the evaporated organic matter line 62.

The evaporator 52 is shaped as a heater coil and it wraps around the evaporation vessel 32. In addition, as the evaporator 52 is wrapped with thermal insulation material 53, heat is prevented from escaping the evaporator 52.

The floor of the evaporation vessel 32 is filled with organic matter liquid 57 to a fixed level. Namely, to a level lower than the evaporation air line 64 and evaporated organic matter line 62.

Air supplied to the supply line 42, turbulent air line 28, evaporation air line 64, and the air hole 15 of the developing gun 10 can be supplied solely from the air supply apparatus 46, or it is possible for air to be supplied by installing different air supply apparatuses for each of the above. Also, when organic material supplied from the organic matter supply apparatus is flammable, air that is supplied through the air supply apparatus 46 is an inert gas such as nitrogen.

The following is an explanation of the operation of the CRT panel developing apparatus according to a preferred embodiment of the present invention, with the above composition.

When the panel fixing portion 4 is fixed to the panel 8, the air supply apparatus 46 operates, air is supplied through the supply line 42, and the powder, that is supplied from the powder supply apparatus 44, by following the flow of the air, moves toward the developing gun 10. At this time, a corona discharge is generated in the fan-shaped electrode 24 according to the amount of electricity that is supplied from the power supply apparatus 48 to the fan-shaped electrode 24 of the powder charging portion 20, and the powder that flows through the powder charging portion 20, comes to be charged. In addition, an ion layer is formed inside the supply line 42 by a grounding electrode 22 that is fixed to the powder charging portion 20, and when air is blown from the air supply apparatus 46, through the turbulent air line 28, and then to the spiral-shaped air inflow mouth 26, turbulence is formed inside the powder charging portion 20, and because the powder that moves from following this turbulence is charged by contacting the ion layer formed inside the supply line 42, the charging of the powder is better achieved.

In the evaporation portion 46, the evaporation vessel 32 and the glass beads 34 that fill the evaporation vessel 32 are heated by the evaporated steam 52 and kept at a temperature higher than the organic matter evaporation temperature (for example, if dioctyl phthalate or dibutyl phthalate is used, this temperature would be between 100 and 150 degrees Celsius), and the organic matter that is flowed into the mouth of the organic matter entrance 39 is evaporated by contact with the inside of the evaporation vessel 32 and the glass beads 34. The evaporated organic matter, by the current of air that is flowed into the air entrance 36, is directed toward the evaporation exit 38.

When the powder (charged in the powder charging portion 20) and the steam of the organic matter (evaporated in the evaporation portion), in this mixed state, flows into the entrance 14 of the developing gun 10, and as the temperature of the flow path 16, formed in the trunk 12 of the developing gun 10, is kept below the condensation temperature of the organic matter, the steam of the organic matter is condensed by the condenser 54 and covers the outside of the powder.

The powder, which is covered by the condensed organic matter, does not stick to the inside surface of the developing gun because of the air that streams in from the developing gun 10 air hole 15, but is sprayed out the exit 18 by the flowing air and adheres to the panel 8 that is fixed to the panel fixing portion 4. At this time, by the grounding of the panel 8 conduction layer through the panel fixing portion 4, an electrical line is formed according to the charged pattern of the panel in the charging process. Also, the powder, which is sprayed out through the exit 18 of the developing gun 10, as it becomes charged in the powder charging portion 20, the sprayed powder adheres to the panel 8 in a determined pattern. In addition, because of the exceptional absorption power of the organic matter, the powder is adhered fast to the panel 8, and because of the surface tension of the liquid organic material, the space surrounding the powder is uniformly adhered without missed portions.

The organic matter, which is condensed inside the developing gun 10, flows through the inside of the developing gun 10 and is retrieved in the drain hole 17. The retrieved organic matter is re-processed and is supplied to the organic matter supply apparatus 56.

In the inside surface of the developing gun 10, a drain groove is formed slanted toward the drain hole 17 which allows the organic matter to effectively be retrieved.

Also, though the developing apparatus using the above CRT panel developing process was presented so as to be applied to the present invention, it can also be applied to a general coating process.

If a cathode-ray-tube developing apparatus organized like that of the above of the present invention is used, as adhesion in the powder is good because of the surface tension of the organic matter, a separate adhesion process is unnecessary. And also because of the surface tension of the organic matter, as the space surrounding the organic matter is kept uniform, because a process of gluing a middle screen after evaporation of an aluminum screen is also not needed, productivity is increased and manufacturing costs are reduced.

Also, if a CRT developing apparatus organized like that of the above of the present invention is used, after the first and second developing of a phosphor material, because an electrical field is kept uniform inside each phosphor material dot, formed by the organic matter, compound colors do not develop (as they would when the electrical field in the phosphor material dots is not equal).

In addition, in the burning process , as all the organic matter is evaporated, foreign substances are not left after the developing process, which results in the screen's clarity being improved. And as the organic matter does not react with the conduction layer and the photocunductive layer, the two layers are not damaged.

Furthermore, as the powder particles are coated by the organic matter so that they are in a separated state, it is not possible for them to become stuck together.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A cathode-ray-tube developing system comprising:

a developing gun, that sprays powder which has been coated by organic matter on to a panel for the cathode-ray-tube;

a supply line, which is a passageway for the supplying of powder and air to the developing gun;

an air supply apparatus that is connected to the supply line;

a powder supply apparatus that is connected to the supply line;

a powder charging portion, which is formed on the supply line and charges the powder that passes through the supply line;

a turbulent air line, which supplies air to the powder charging portion;

a power supply apparatus that supplies electrical power to the powder charging portion;

an evaporation portion in which the organic matter evaporates;

an evaporated organic matter line, which connects the evaporation portion and the supply line;

an organic matter supply apparatus, which supplies organic matter to the evaporation portion; and an organic matter line which connects the evaporation portion and the organic matter supply apparatus.

2. The CRT panel developing apparatus according to claim 1, wherein the developing gun comprises:

a trunk;

a condenser, fixed to the outside of the trunk;

an entrance, formed on one side of the trunk and into which the powder and organic matter flows;

a flow path, formed inside the trunk;

an exit, formed on the other side of the trunk (other side of the entrance) through which the powder, coated with the condensed organic matter, is sprayed;

a drain hole, used for retrieving the organic matter condensed to the inside of the trunk; and an air hole, that blows air so that the powder, which has flowed into the developing gun, is separated from the wall of the developing gun and directed toward the exit.

3. The CRT panel developing apparatus according to claim 1, wherein the condenser is pipe-shaped and is wrapped around the outside of the developing gun's trunk.

4. The CRT panel developing apparatus according to claim 1, wherein the powder charging portion comprises:

a grounding electrode, fixed to the wall of the supply line;

a fan-shaped electrode, fixed to the center of the supply line and connected to the power supply apparatus;

an air flow mouth, spiral-shaped and fixed adjacent to the wall of the supply line; and a turbulent air line, which connects the air flow mouth and the air supply apparatus.

5. The CRT panel developing apparatus according to claim 1, wherein the evaporation portion comprises:

an evaporation vessel;

glass beads, which fill the inside of the evaporation vessel;

an air entrance, connected to the evaporation air line;

an organic material entrance, connected to the organic material supply apparatus;

an evaporator, fixed to the outside of the evaporation vessel; and an evaporation exit, connected to the evaporated organic material line.

6. The CRT panel developing apparatus according to claim 1, wherein the condenser is shaped as a heater coil and wraps the outside of the evaporation vessel.

7. The CRT panel developing apparatus as in any one of claims 1–6, wherein the organic matter is dioctyl phthalate (DOP).

8. The CRT panel developing apparatus as in any one of claims 1–6, wherein the organic matter is dibutyl phthalate (DBP).

9. The CRT panel developing apparatus as in any one of claims 1–6, wherein the organic matter is dioctyl sebacate (DOS).

10. The CRT panel developing apparatus as in any one of claims 1–6, wherein the organic matter is linolenic acid (LA).

11. The CRT panel developing apparatus as in any one of claims 1–6, wherein the organic matter is oleic acid (OA).

12. The CRT panel developing apparatus as in any one of claims 1–6, wherein the organic matter is stearic acid (SA).

13. The CRT panel developing apparatus as in any one of claims 1–6, wherein the organic matter is glycerol (G).

* * * * *